US005156268A

United States Patent [19]

Nichols

[11] Patent Number: 5,156,268

[45] Date of Patent: Oct. 20, 1992

[54] COMPOSITE SHIPPING CONTAINER FOR COMBUSTIBLE LIQUIDS

[75] Inventor: Dwight E. Nichols, Beatrice, Nebr.

[73] Assignee: Hoover Group, Inc., Alpharetta, Ga.

[21] Appl. No.: 625,158

[22] Filed: Dec. 10, 1990

[51] Int. Cl.[5] ..... B65D 19/00; B65D 88/00

[52] U.S. Cl. ..... 206/386; 220/1.5

[58] Field of Search ..... 220/1.5; 206/386, 395, 206/398, 600

[56] References Cited

U.S. PATENT DOCUMENTS

| | | | |
|---|---|---|---|
| 2,271,660 | 2/1942 | Norbom | 220/1.5 X |
| 4,165,024 | 8/1979 | Oswalt et al. | 206/386 X |
| 4,930,661 | 6/1990 | Voorhies | 220/1.5 X |

FOREIGN PATENT DOCUMENTS

| | | | |
|---|---|---|---|
| 475252 | 7/1951 | Canada | 220/1.5 |
| 0284290 | 9/1988 | European Pat. Off. | 206/386 |
| 3009173 | 9/1981 | Fed. Rep. of Germany | 206/600 |

*Primary Examiner*—Paul T. Sewell
*Assistant Examiner*—Beth Anne Cicconi
*Attorney, Agent, or Firm*—Harness, Dickey & Pierce

[57] ABSTRACT

A composite container for storing flammable and combustible liquids. The container includes a generally rigid outer container having upright continuous side walls and a substantially flat top wall. One of the side walls includes an access opening adjacent to the base of the wall. A unitary blow molded plastic inner tank is positioned inside of the outer container which maintains the inner tank in its upright position when the tank is filled with a liquid. A discharge fitting of the tank is positioned adjacent to the access opening to facilitate the discharge of liquid from the tank. A cover coacts and engages the access opening to seal the outer container against the leakage of liquid from the tank. The outer container and inner tank are supported on a pallet member having a top surface and depending legs which are spaced apart to enable the extension of fork lift tines therebetween.

2 Claims, 1 Drawing Sheet

COMPOSITE SHIPPING CONTAINER FOR COMBUSTIBLE LIQUIDS

BACKGROUND AND SUMMARY OF THE INVENTION

Liquid material in bulk form is commonly stored and transported in a variety of large containers. The most common being the conventional 55 gallon drum. The disadvantages of the drum involve the cylindrical container's inefficient use of storage space, the necessity of inverting the drum for discharge purposes and the necessity of returning the drum empty.

In recent years, cubic metal containers having removable inner polyethylene tanks have provided an advantageous alternative to the 55 gallon drum. Specifically, the containers could be used for one way shipping However, the earlier of these cubic containers displayed disadvantages in that the polyethylene tank was often difficult to separate from the outer metal container. Separation is required when it is desirable to recycle the container materials for subsequent use.

A problem not addressed by either the 55 gallon drum or the cubic containers mentioned above involves the storage of flammable or combustible liquids in public facilities. From a safety standpoint, such public storage is only feasible if all potential points of leakage are eliminated or blocked so that the liquid cannot escape from the container.

It is an object of the present invention, therefore, to provide a composite shipping container which has the ability to permit combustible liquid storage in public facilities.

It is a feature of the present invention to provide a cover positioned over an access opening for the discharge fitting of the container.

The present invention is advantageous in that the discharge fitting is protected from inadvertent contact which might result in damage being incurred thereto. The present invention is further advantageous in that it provides a secondary seal for retaining any liquid inadvertently leaking or escaping from the inner tank or the discharge fitting.

The composite shipping container of this invention includes a rigid outer container of rectangular shape. The outer container has continuous upright side walls and a substantially flat top wall.

A unitary blow molded plastic inner tank is positioned upright inside of the outer container The side walls of the inner tank are sufficiently thin to prevent the tank from being self supporting. For this reason, the walls of the outer container are formed of a rigid material that is sufficiently strong to support the inner tank when filled with liquid. The tank also includes an inlet fitting, which is accessible through a fill opening of the outer container, and a discharge fitting, which is accessible through an access opening of the outer container.

The outer container is mounted on a pallet member having a top surface and depending legs. The spacing of the pallet member legs permits the extension of fork lift tines therebetween to facilitate handling and manipulation of the container during both transport and storage.

A removable cover is provided to close and seal the access opening. The cover protects the inlet fitting and prevents any inadvertent leakage of liquid from the tank.

As disclosed, the composite shipping container of this invention can be employed to store flammable or combustible liquids in public warehouses. The cover provides for a liquid tight seal over the access opening and thereby prevents any liquid inadvertently leaking from the tank from escaping the container 10 and creating a safety hazard. The present invention also has the advantage of being a non-reusable, one way shipping container. After the container has been emptied, the container may be wholly disposed of or the polyethylene inner tank may be removed from the rigid outer container and the materials recycled In that the composite container is non-reusable one-way shipper, from a cost standpoint the invention has obvious advantages, but, the container also ensures that contaminants are not introduced to the liquid as a result of previous use.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWING

Figure 1:
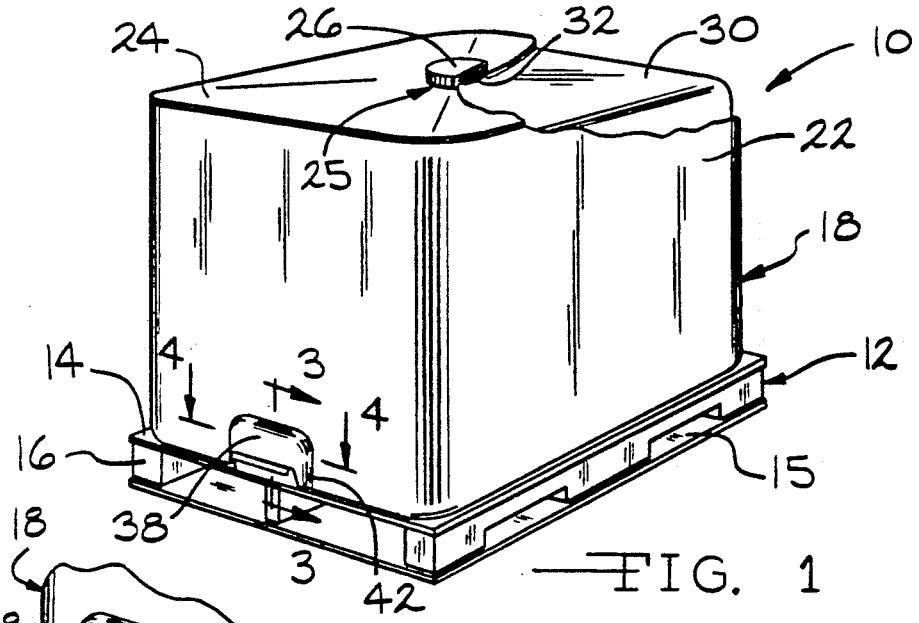
FIG. 1 is a perspective view of the composite shipping container of this invention.
Figure 2:
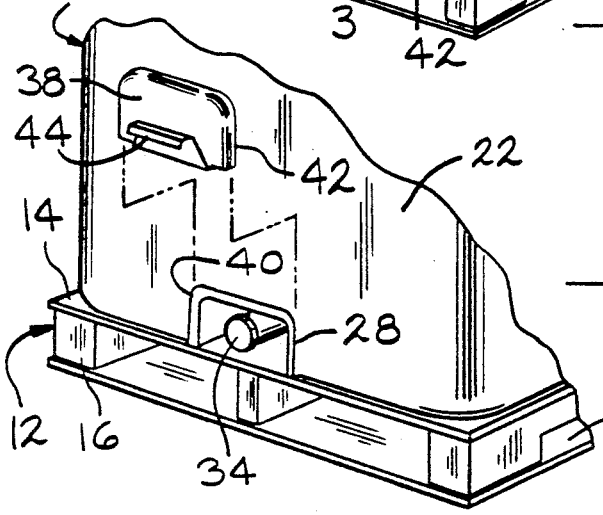
FIG. 2 is a partial perspective view of the present invention and illustrates the cover in exploded relation with the access opening.
Figure 3:
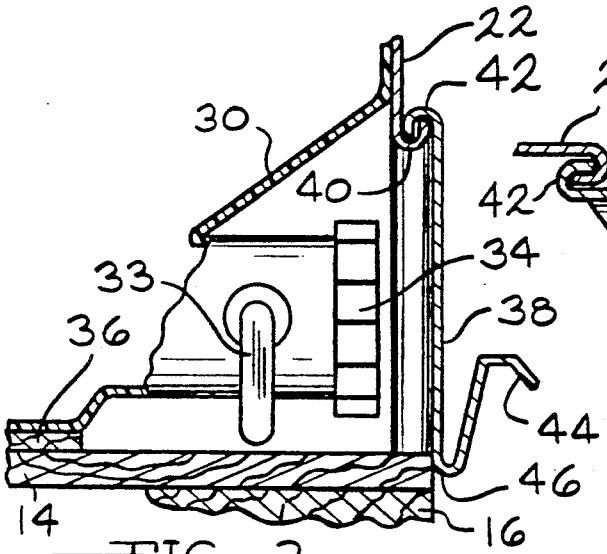
FIG. 3 is a sectional view taken substantially along line 3—3 in FIG. 1 showing a portion of the container with the cover mounted over the access opening.
Figure 4:
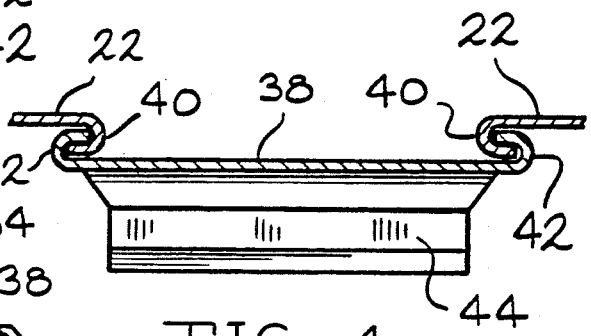
FIG. 4 is a sectional view taken substantially along line 4—4 in FIG. 1 showing the cover positioned over the access opening of the container.

Now with reference to the drawing, the composite shipping container of the present invention is illustrated in FIG. 1 at 10 and includes a wooden pallet member 12 having a top surface 14, a bottom surface 15 and depending leg 16. The legs 16 are spaced apart to enable the extension of fork lift tines (not shown) therebetween for facilitating the moving and handling of the container 10 during both transport and storage.

The container also includes an outer container 18 of a generally cubic or rectangular shape which is supported on and secured to the top surface 14 of the pallet member 12. Such securement may be achieved through the various methods known in the industry including the use of brackets and fasteners. The outer container 18 itself includes upright continuous side walls 22 and a substantially flat top wall 24 that is secured thereon. All of the walls 22 and 24 are formed of a substantially rigid, corrosion resistant material. An example of a material that is readily available from various suppliers and includes these characteristics is galvanized heat rolled steel.

Formed in the top wall 24 is a central fill opening that is sealed by a closure cap 26. One of the side walls 22 includes an access opening 28 located adjacent to the bottom of the side wall 22. The access opening 28 is described in further detail below.

A unitary blow molded plastic inner tank 30 is positioned upright inside of the outer container 18. The inner tank 30 is constructed with substantially thin walls which are incapable of allowing the tank 30 to be self supportive. Thus, when filled with a liquid, the tank 30 is supported in its upright position by the rigidity of the side walls 22 of the outer container. An inlet fitting 32 extends from the top of tank 30 into the fill opening 25 which is sealed by the closure cap 26 of the outer container 18. The tank 30 also includes a discharge fitting 34 which is positioned thereon adjacent to the access opening 28 of the outer container 18. So positioned, a valve 33 of the discharge fitting 34 is accessed from outside of the container 10 to facilitate the discharge of liquid from the tank 30.

The inner tank 30 freely engages the interior surfaces of the outer container 18. If desired, the tank 30 can be nested at its lower end in support blocks 36 to help maintain the position of the discharge fitting 34 relative to the access opening 28.

Because the container 10 is used for transporting and storing of flammable and/or combustible liquids in public areas, the outer container 18 must be capable of preventing any liquid from escaping out of the container 10 should a leak develop in the inner tank 30. In achieving this, the container 10 is provided with a cover 38 for the access opening 28.

When positioned on the outer container 18, the cover 38 closes and forms a seal around the access opening 28 guarding against leakage of liquid from the tank 30 therethrough. To permit mounting of the cover 38, the access opening 28 is defined by an outwardly flared perimeter or flange 40. Likewise, the cover 38 is provided with a flared perimeter or flange 42 of a shape which will coact with the flared perimeter 40 of the access opening 28, thereby closing and sealing the tank 30.

Preferably, the perimeter 42 of the cover 38 is flared on three sides and allows the cover to be slid downward into a channeled frictional engagement with the flared perimeter 40 of the access opening 28. To facilitate this engagement, and the subsequent disengagement, a handle 44 extends outward from the cover 38 When mounted, a lowermost edge 46 of the cover 38 engages the upper surface 14 of the pallet 12 to cooperate with the flared perimeters 40 and 42 and form a liquid tight seal around the access opening 28 The seal formed by the cover 38 prevents any liquid which might inadvertently leak from the discharge fitting 34, or the tank 30 itself, from also leaking out of the access opening 28 and into the storage facility where it would pose a substantial safety hazard.

While not required, to further ensure the integrity of the seal between the cover 38 and the access opening 28, the respective flanges 40 and 42 and other sealing surfaces may also employ a gasketing material therearound. This material should be impervious to the combustive or flammable liquid that is to be stored within the container 10.

Since the container 10 is of a generally rectangular construction, it is efficiently transported and stored. With the location of the discharge fitting 34 being adjacent to the bottom of the tank 30, the shipping container 10 can be completely emptied without requiring a significant amount of manipulation. Once emptied, the shipping container is readily disassembled by removing the top wall 24 and withdrawing the tank 30. The outer container 18 and the tank 30 can then be separately recycled according to processes appropriate for both materials.

While the above description constitutes the preferred embodiments of the present invention, it will be appreciated that the invention is susceptible to modification, variation and change without departing from the proper scope and fair meaning of the accompanying claims.

What is claimed is:

1. A composite container for storing and transporting flammable and combustible liquids, said composite container comprising:

a. a pallet member having a top surface and depending legs;

b. an upright outer container of generally rigid material, said outer container being supported on and secured to said pallet top surface;

said outer container having a top wall and at least one side wall being provided with an access opening located adjacent said pallet member;

said top wall having a central fill opening;

c. a unitary blow molded plastic inner tank positioned upright inside said outer container, said tank having an inlet fitting extending into said container fill opening, and a discharge fitting positioned within said container at a position adjacent said access opening so as to be accessible from outside said container to facilitate discharge of liquid from said tank; and d. a cover for said access opening operable when applied to said container to close and seal said access opening against leakage of liquid from said tank through said access opening and coacting means on said outer container and said cover for removably mounting said cover on said one side wall, said coacting means including a flange on said outer container extending substantially around three sides of said access opening as a flared perimeter.

2. A composite container for storing and transporting flammable and combustible liquids, said composite container comprising:

a. a pallet member having a top surface and depending legs;

b. an upright outer container of generally rigid material, said outer container being supported on and secured to said pallet top surface;

said outer container having a top wall and at least one side wall being provided with an access opening located adjacent said pallet member;

said top wall having a central fill opening;

c. a unitary blow molded plastic inner tank positioned upright inside said outer container, said tank having an inlet fitting extending into said container fill opening, and a discharge fitting positioned within said container at a position adjacent said access opening so as to be accessible from outside said container to facilitate discharge of liquid from said tank; and d. a cover for said access opening operable when applied to said container to close and seal said access opening against leakage of liquid from said tank through said access opening and coacting means on said outer container and said cover for removable mounting said cover on said one side wall, said coacting means including a flange on said outer container and a flange on said cover of a shape corresponding with said container flange and being fictionally engaged therewith, said cover flange extending substantially around three sides of the perimeter of said cover.

* * * * *